United States Patent [19]

Röck

[11] Patent Number: 4,508,394

[45] Date of Patent: Apr. 2, 1985

[54] DRAWER GUIDE ASSEMBLY

[75] Inventor: Erich Röck, Höchst, Austria

[73] Assignee: Julius Blum Gesellschaft m.b.H., Höchst, Austria

[21] Appl. No.: 467,224

[22] Filed: Feb. 17, 1983

[30] Foreign Application Priority Data

Feb. 17, 1982 [AT] Austria ..... 601/82

[51] Int. Cl.[3] ..... F16C 29/04; A47B 88/00

[52] U.S. Cl. ..... 308/3.8; 312/334; 312/348

[58] Field of Search ..... 308/3.8, 3.6; 312/348, 312/342, 345, 334, 350, 343

[56] References Cited

U.S. PATENT DOCUMENTS

| | | | |
|---|---|---|---|
| 3,738,716 | 6/1973 | Lambert | 308/3.8 |
| 3,904,254 | 9/1975 | Hagen | 308/3.8 X |
| 4,057,303 | 11/1977 | Röck et al. | 308/3.6 |
| 4,255,002 | 3/1981 | Röck et al. | 308/3.6 X |

FOREIGN PATENT DOCUMENTS

| | | | |
|---|---|---|---|
| 351198 | 7/1979 | Austria . | |
| 2641375 | 3/1978 | Fed. Rep. of Germany | 312/348 |
| 2819099 | 11/1978 | Fed. Rep. of Germany | 312/334 |
| 3101594 | 1/1982 | Fed. Rep. of Germany | 312/345 |
| 2079585 | 1/1982 | United Kingdom | 312/343 |

*Primary Examiner*—Stuart S. Levy
*Assistant Examiner*—Thomas Hannon
*Attorney, Agent, or Firm*—Wenderoth, Lind & Ponack

[57] ABSTRACT

A drawer guide assembly for use on each side of a drawer includes a roller carrier. The roller carriers run in grooves in the drawer side walls, and there are only two support rails but no pull-out rails. To prevent the roller carriers from being unintentionally pushed over the rear ends of the support rails, two stops are provided on each rail. One stop extends vertically and the other extends laterally.

4 Claims, 7 Drawing Figures

DRAWER GUIDE ASSEMBLY

BACKGROUND AND FIELD OF THE INVENTION

The invention relates to a drawer guide assembly for drawers, particularly for plastics drawers, comprising, on each side of the drawer, a drawer side wall with a guide groove, a roller carrier with rollers being directly guided in the groove, and a support rail on the side of the body of the article of furniture, the running flange of the support rail extending into the roller carrier. Stops for the roller carrier are arranged in the guide grooves, and the support rails also are provided with stops limiting the path of the roller carriers toward the rear ends of the support rails.

DESCRIPTION OF THE PRIOR ART

Guide assemblies in which the rollers are not fastened in the rails, but rather are mounted in a freely movable roller carrier, are frequently used. They ensure smooth running of the drawer and economical production. Drawer guide assemblies are generally provided on each side with guide rails on the sides of the body and the drawer, the roller carrier rolling between them. One of the rails has a U-shaped profile, and the roller carrier is inserted into this rail.

There are drawers of plastics material in particular, in which the rail on the side of the drawer is not required, and the roller carrier is directly inserted into a guide groove provided in the drawer side wall.

It is obvious that a drawer guide assembly of this kind can be produced at low cost because only two rails are needed instead of four. Drawers provided with such pull-out guides function satisfactorily, but difficulties arise, in particular when the drawer has been taken out of the cabinet and is to be reinserted.

Studies have shown that the difficulties are caused by the fact that the stability of the drawer side wall and, hence the dimensional stability of the guide groove, is lower than that of a metal rail.

It can happen that the roller carrier is pushed over the rear end of the support rail and as a result the pull-out guide is completely blocked and in some cases the drawer side wall can be broken.

As such pushing over the rear end of the support rail is caused by deformation of the drawer side wall and the guide groove, in the past the drawer side wall has been reinforced.

This solution is not entirely satisfactory. Costs of material for manufacturing the drawer side walls is increased, and satisfactory reinforcement of the side walls is obtained only by inserting a metal rail, such measure eliminating the afore-mentioned advantage of particularly low cost.

SUMMARY OF THE INVENTION

It is the object of the invention to provide a drawer guide assembly of the afore-mentioned kind in which these disadvantages are eliminated and in which the position of the roller carrier on the body rail is ensured even if the drawer, having been removed, is incorrectly reinserted into the body.

According to the invention this is achieved by providing at least two stops at the rear end of each support rail, the first of the stops being bent out from the running flange and the second stop being bent out from the vertical flange of the support rail, preferably by punching, the first stop extending vertically and the second stop extending laterally.

It is advantageously provided that a stop surface for one stop of the support rail be arranged on the roller carriers above the rearmost roller, and be positioned to extend at an angle of between 30° and 60° with respect to the running surface of the guide groove.

Particularly efficient guiding of the roller carrier has been obtained by bending the running flange of each support rail downwardly at a position forwardly of the stops.

The two stops are preferably vertically aligned.

BRIEF DESCRIPTION OF THE DRAWINGS

In the following embodiments of the inventions will be described in detail with reference to the accompanying drawings, without being limited thereto, and wherein.

DESCRIPTION OF THE PREFERRED EMBODIMENTS

One side of the drawer and of the guide assembly will now be described. It is obvious that the opposite side is analogous.

The guide assembly according to the invention comprises a support rail 1 to be mounted on the side of a body of an article of furniture, a drawer side wall 2 and a roller carrier 3 in which rollers 4 are arranged.

Figure 1:
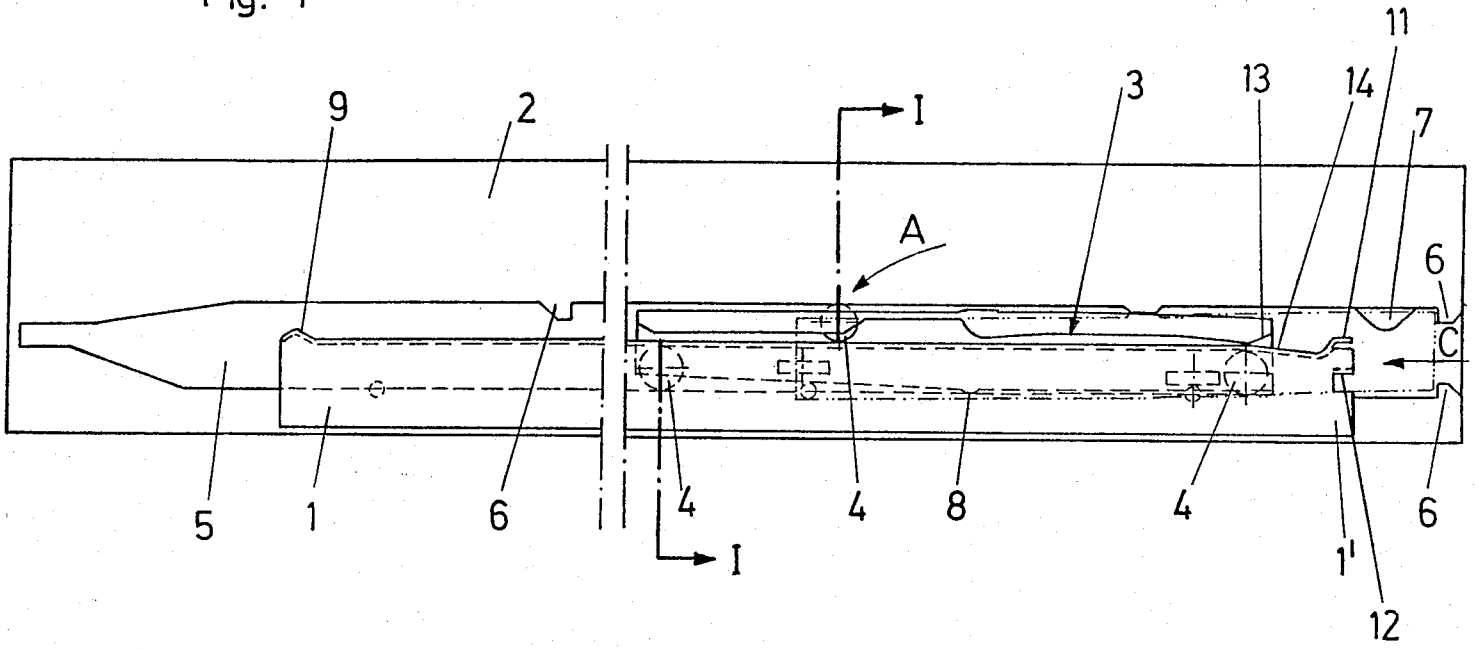
FIG. 1 is a schematic side view of one side of a drawer with a guide assembly according to the invention.
Figures 2, 3, 4, 5, 6, 7:
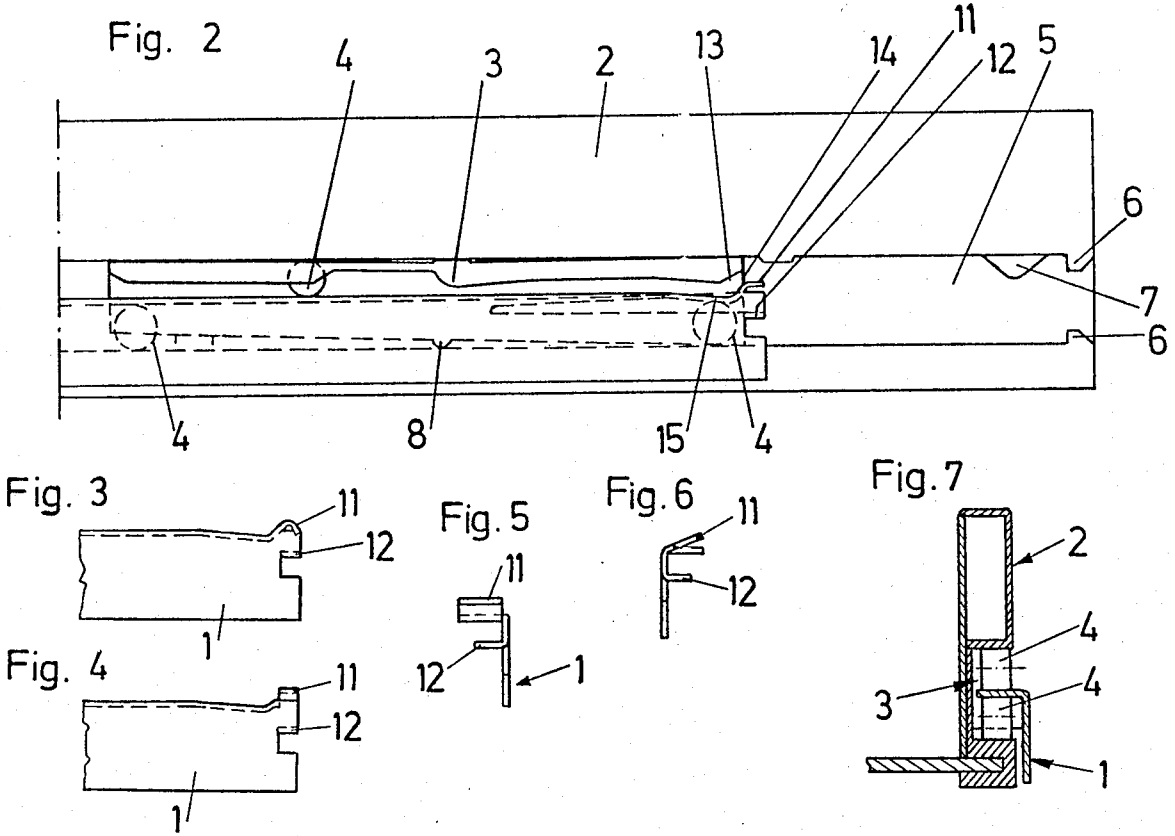
FIG. 2 is a partial view similar to FIG. 1, the roller carrier and the body rail being shown in the position which makes the roller carrier stop.
FIGS. 3 and 4 are side views of the rear end of the support rail on the side of the body.
FIG. 5 is a view thereof from the left of FIG. 3.
FIG. 6 is a view thereof from the direction of arrow C of FIG. 1.
FIG. 7 is a sectional view along line I—I of FIG. 1.

The drawer side wall 2 has a guide groove 5 in which the roller carrier 3 is guided. The guide groove 5 and, hence, the side wall 2 is provided with stops 6 which serve to position the roller carrier 3. The drawer side wall 2 further has a retaining pin 7. When the drawer has been taken out, i.e. out of the body, the roller carrier 3 is in the position indicated by dot and dash lines. The roller carrier 3 has at least one knob 8 around which it is pivotable in the direction of arrow A of FIG. 1, the retaining pin 7 thus engaging the roller carrier 3. In this respect, reference is made to U.S. Pat. No. 4,255,002.

When the drawer is reinserted into the body of the piece of furniture, i.e. the roller carrier 3 is pushed onto the support rail 1, the roller carrier is unlocked by a stop 9 at the front end of the support rail 1 and can run freely between the drawer side wall 2 and the support rail 1.

The roller carrier 3 is prevented from being pushed over the rear end 1' of the support rail, according to the invention, by means of stops 11, 12. In the illustrated embodiment, the stops 11, 12 are formed by two flaps, one being bent out from the horizontal flange of the support rail and one from the vertical flange of the support rail 1. The stop 11 rests against a stop surface 13 on the roller carrier 3, when the roller carrier 3 has been displaced, the stop 12 rests against a lateral stop surface 14.

The running flange of the support rail 1 is in front of the stop 11 bent downwardly as indicated by the reference number 15.

With a drawer guide assembly according to the invention the roller carrier 3 cannot be pushed beyond the stops 11, 12. When the roller carrier 3 is in an incorrect, i.e. displaced, position, it comes to rest at the stops 11, 12 and remains there until the drawer has been pushed fully into the body of the piece of furniture. It is obvious that no rolling motion but a sliding motion takes place. When the drawer is pulled out again, one hundred percent function of the drawer guide is ensured.

What is claimed is:

1. A drawer guide assembly for use on each of opposite sides of an article of furniture of the type wherein a drawer is slidably insertable into and removable from a furniture body, said assembly comprising:

a drawer side wall having therein a guide groove;

a roller carrier supporting rollers directly guided for longitudinal movement in said groove;

a support rail to be attached to a side of a furniture body into which is inserted the drawer, said support rail having a vertical flange and a horizontal flange extending from said vertical flange into said roller carrier and on which run said rollers;

whereby said roller carrier is longitudinally movable with respect to said groove and said support rail during movement of the drawer into and from the furniture body;

said groove having at an inner end thereof stop means for retaining said roller carrier in said groove upon complete removal of the drawer from the furniture body; and said support rail having an inner end including means for preventing said roller carrier from moving therebeyond, said preventing means comprising a first stop bent outwardly and extending upwardly from said horizontal flange at a position to abut a first stop surface at a rear end of said roller carrier and a second stop bent outwardly and extending laterally from said vertical flange at a position to abut a second stop surface at said rear end of said roller carrier.

2. An assembly as claimed in claim 1, wherein said horizontal flange is bent downwardly at a position forwardly of said first and second stops.

3. An assembly as claimed in claim 1, wherein said first stop surface is inclined at an angle of from 30° to 60° with respect to the longitudinal direction of said groove.

4. An assembly as claimed in claim 1, wherein said first and second stops are vertically aligned.

* * * * *